US006928952B2

(12) United States Patent
Garcia

(10) Patent No.: US 6,928,952 B2
(45) Date of Patent: Aug. 16, 2005

(54) COMPACT SAFETY CONE

(75) Inventor: Guadalupe C. Garcia, Modesto, CA (US)

(73) Assignee: Worldwide Safety of Nevada, Inc., Sacramento, CA (US)

( * ) Notice: Subject to any disclaimer, the term of this patent is extended or adjusted under 35 U.S.C. 154(b) by 0 days.

(21) Appl. No.: 10/769,298

(22) Filed: Jan. 30, 2004

(65) Prior Publication Data

US 2004/0250744 A1 Dec. 16, 2004

Related U.S. Application Data

(63) Continuation-in-part of application No. 10/131,316, filed on Apr. 23, 2002, now Pat. No. 6,766,760.

(60) Provisional application No. 60/351,557, filed on Jan. 23, 2002, provisional application No. 60/360,141, filed on Feb. 22, 2002, and provisional application No. 60/444,278, filed on Jan. 31, 2003.

(51) Int. Cl.[7] ..... E01F 9/00

(52) U.S. Cl. ..... 116/63 C; 116/63 P

(58) Field of Search ..... 116/63 P, 63 R, 116/63 C; 40/612; 404/6, 9, 10

(56) References Cited

U.S. PATENT DOCUMENTS

| | | | | |
|---|---|---|---|---|
| 2,333,273 A | | 11/1943 | Scanlon | 116/63 R |
| 3,132,624 A | | 5/1964 | Shoemaker, Jr. | 116/63 R |
| 3,386,409 A | | 6/1968 | Dawson | 116/63 R |
| 3,596,628 A | * | 8/1971 | Wright | 116/63 P |
| 3,851,615 A | * | 12/1974 | Grundvig et al. | 116/63 R |
| 4,588,324 A | * | 5/1986 | Goellner | 404/9 |
| 5,199,375 A | * | 4/1993 | Johson | 116/63 P |
| 5,375,554 A | | 12/1994 | Yen | 116/63 C |
| 5,488,792 A | | 2/1996 | Kwok | 40/612 |
| 6,338,311 B1 | | 1/2002 | Ho | 116/63 C |
| 6,622,408 B2 | | 9/2003 | Dicke et al. | 40/610 |

OTHER PUBLICATIONS

"Collapsible Cone," retrieved on Jan. 26, 2004. Retrieved from the internet: < URL: http://www.safetycentral.com/co16sptrsaco.html >.

"Highway Safety Products," retrieved on Jan. 26, 2004. Retrieved from the internet: < URL: http://www.western-safety.com/hwaysafe1.html >.

* cited by examiner

*Primary Examiner*—Christopher W. Fulton
*Assistant Examiner*—Travis Reis
(74) *Attorney, Agent, or Firm*—Lumen Intellectual Property Services, Inc.

(57) ABSTRACT

A compact safety cone that can self-right when in use and be reduced to a compact size when not. The compact safety cone has a base, flexible means, and cover. The spring flexible means coils around the center of the base in decreasing diameters without overlapping. The compact safety cone has a substantially low center of gravity due to the weight distribution among its components. By design, the compact safety cone has a fast impulse response to direct (contact) and indirect (no-contact) perturbations and is capable of being run over or hit by a vehicle and "self-right" substantially immediately after the impact. When not in use, an integrated holding means conveniently and securely keeps the flexible means to the base. The holding means can be, e.g., a cover, lid, light, sign, mirror, box, case, hook, latch, strap, Velcro, pin, lock, etc. In some cases, an optional handle may be included.

15 Claims, 8 Drawing Sheets

COMPACT SAFETY CONE

CROSS-REFERENCE TO RELATED APPLICATIONS

The present application is a continuation-in-part of a U.S. patent application Ser. No. 10/131,316, filed Apr. 23, 2002, now U.S. Pat. No. 6,766,760, which claims priority from provisional patent applications Nos. 60/351,557, filed Jan. 23, 2002, and Ser. No. 60/360,141, filed Feb. 22, 2002, all of which are incorporated herein by reference. This application also claims priority from a provisional patent application No. 60/444,278, filed Jan. 31, 2003, the entire content of which is incorporated herein by reference. This application also relates to a co-pending U.S. patent application Ser. No. 10/763,399, filed Jan. 23, 2004, which claims priority from a provisional patent application No. 60/442,355, filed Jan. 23, 2003, and a PCT Application No. US03/02116, filed Jan. 23, 2003, all of which are incorporated herein by reference.

FIELD OF THE INVENTION

The present invention relates generally to traffic marker devices and more particularly to new designs and manufacture of a compact flexible safety cone integrated with a versatile holding means that can function as a sign, a warning light, a display unit, etc., allowing the same to be carried, held, transported, displayed, or stored in a compact and convenient fashion while enhancing its safety feature, display utility, and visibility.

DESCRIPTION OF THE BACKGROUND ART

Traffic marker devices such as safety cones are useful in alerting, directing, or diverting motorists as well as pedestrians to avoid or pass safely around hazards, obstacles, work zones, and so on. Several designs of safety cones exist today. The most common design is perhaps the bright orange colored, hollow conical shaped rigid cones that are made of a single piece of molded hard rubber or polyvinyl chloride (PVC) plastic (see, for example, U.S. Pat. No. 2,333,273, issued to Scanlon et al.). Especially in consumer applications, carrying these cumbersome rigid cones could be a challenge, not to mention that they would take up a significant amount of precious space in a trunk or cargo area of a vehicle.

Since these rigid safety cones are neither easy nor practical to carry or transport in a consumer vehicle, average consumers are discouraged to use them, despite the fact that they could be very useful in case of a roadside emergency/assistance, e.g., increase safety and visibility when an individual's vehicle is stalled.

U.S. Pat. No. 5,488,792, issued to Kwok, discloses a mobile traffic warning sign that includes a heavy flat base, a conical spring fastened to the base at the top by holding-down plates and screws, and a collapsible conical covering, and a case for receiving the warning traffic warning sign when the conical covering and the conical spring are collapsed and received in a circular recess on the base.

Kwok's mobile traffic warning sign is simple in structure and easy to carry. However, it does not have a self-right mechanism. Thus, when confronted by an indirect or direct force, e.g., natural wind, passing traffic, or violence, it is likely to fall over or collapse and become a flying or lying object endangering following traffic and/or surrounding people.

U.S. Pat. No. 6,338,311, issued to Ho, discloses a telescopic roadblock comprising a base and a cone on the base.

The cone has a telescopic structure defined by concentric hard conical sleeves that are connected together by a soft material. The hard conical sleeves have the same height and decreasing diameters with the smallest diameter set on the topmost end. The cone can be compressed down to the same height as a hard conical sleeve.

Ho's telescopic roadblock is small, convenient, and easy to carry. However, it does not have a self-right mechanism. Thus, similar to Kwok's mobile traffic warning sign, when confronted by an indirect or direct force, e.g., natural wind, passing traffic, or violence, Ho's telescopic roadblock is likely to fall over or collapse and become a flying or lying object endangering following traffic and/or surrounding people.

Clearly, there is still a need for a traffic safety cone that can self-right when in use and that can be reduced or otherwise minimized to a compact size when not in use, thereby allowing an average consumer to hold, carry, transport, and/or store the safety cone in a convenient and effortless manner.

SUMMARY OF THE INVENTION

The present invention enhances and improves a new type of traffic safety cones, an embodiment of which is shown in FIG. 1, hereinafter referred to as the flexible safety marker device. The flexible safety marker device has a base, a spring, and a cover. The base may have an opening large enough to allow stacking. The spring is attached to the base and coils around the center of the base in decreasing diameters without overlapping each loop of the spring. In some embodiments, the bottom end of the spring, which is not limited to one complete loop and could have less or more, has a diameter that is sufficiently larger than the opening of the base. The cover is made of a breathable, flexible material, e.g., a nylon mesh, to allow easy movement of the spring and may be brightly colored and/or reflective in all or some portions thereof to enhance visibility. The flexible safety marker device has a low center of gravity due to the weight distribution and allocation of the components thereof, i.e., the base, the spring, and the cover.

By design, the flexible safety marker device has a fast impulse response to direct (contact) and indirect (no-contact) perturbations and is capable of being run over or hit by a vehicle and "self-right" substantially immediately after the impact. The flexible safety marker device and its advantages are particularly described in the above-referenced patent applications. The present invention discloses herein new and improved compact flexible safety marker devices with enhanced transportability, functionality, and visibility while advantageously maintaining its resilient and fast self-right capability. In some embodiments, the new and enhanced designs of the flexible safety marker device include a variety of holding means to keep the flexible spring to the base in a reduced and compact position. The holding means can be, for example, a sign, a cover, a light, a mirror, a box, a case, a hook, a latch, a strap, a Velcro, a pin, a lock, and the like.

In some embodiments, the holding means is a lid securely attached to the base via a movable joint such as hinge. The lid holds down the flexible spring via a securing means such as a latch or a lock. In certain embodiments, the lid functions as a sign that self-erects upon the release of the securing means, thereby complementing the safety marker device.

In some embodiments, the holding means is a light-emitting device attached to the base via a movable joint such as hinge. The light-emitting device has a housing, a light bulb, batteries, and a switch. The light-emitting device holds down the flexible spring via a locking pin, which is conveniently attached to the movable joint or the base. A hollow or solid body member perturbs from the backside of the light bulb residing end of the housing. The body member, whose shape is not limited to cylindrical, has an overall diameter that is slightly smaller than the diameter of the top loop of the flexible spring such that, when in holding position, the body member fits inside the loops of the flexible spring to prevent them from moving. In certain embodiments, the movable joint has a spring mechanism that causes the light-emitting device to self-erect upon the release of the locking pin. In some embodiments, the flexible safety marker device is integrated with a handle, making it even easier to carry, store, or display the device.

Still further objects and advantages of the present invention will become apparent to one of ordinary skill in the art upon reading and understanding the detailed description of the preferred embodiments and the drawings illustrating the preferred embodiments disclosed herein.

DETAILED DESCRIPTION OF THE PREFERRED EMBODIMENTS

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

Figure 1:
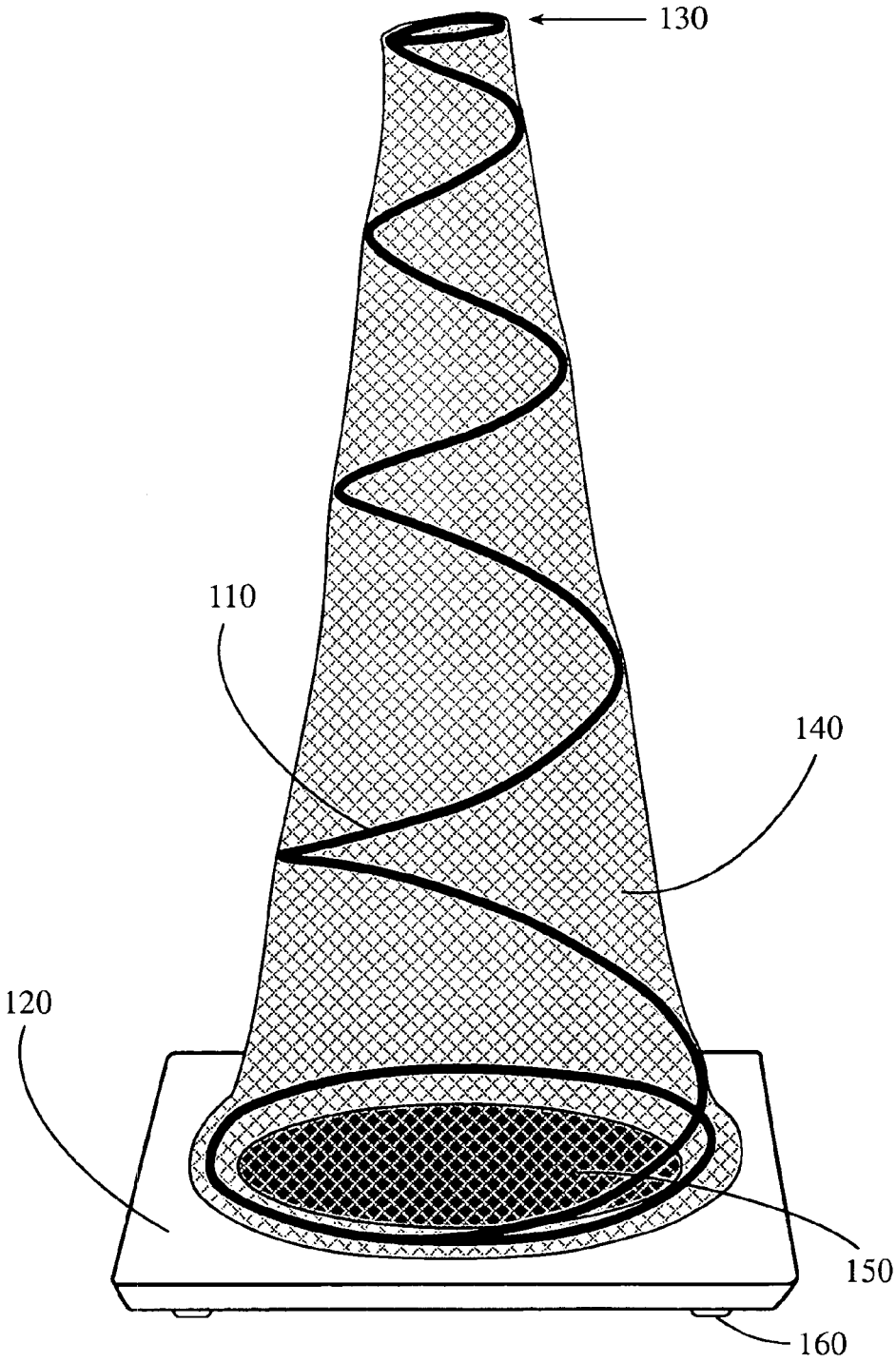
FIG. 1 illustrates a flexible safety marker device in which the present invention may be embodied.
Figure 2A:
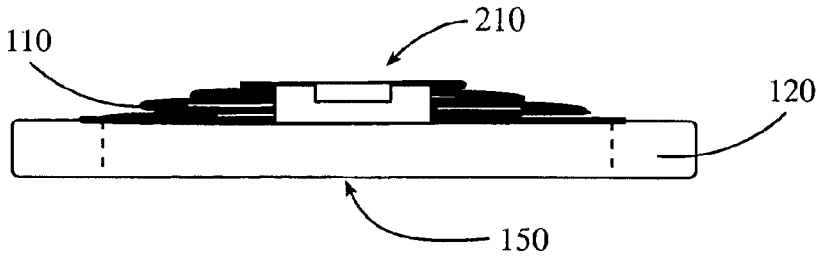
FIG. 2A show the front view of an embodiment of the flexible safety marker device of FIG. 1 in a reduced, compact position, implementing a holding means according to the present invention.
Figure 2B:
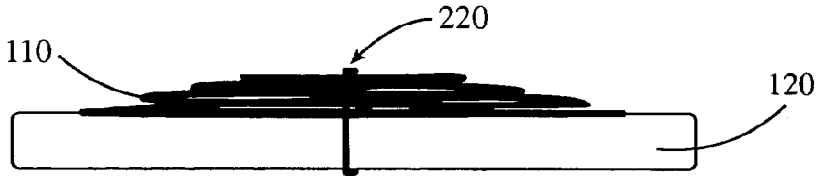
FIG. 2B show the front view of another embodiment of the flexible safety marker device of FIG. 1 in a reduced, compact position, implementing a holding means according to the present invention.
Figure 2C:
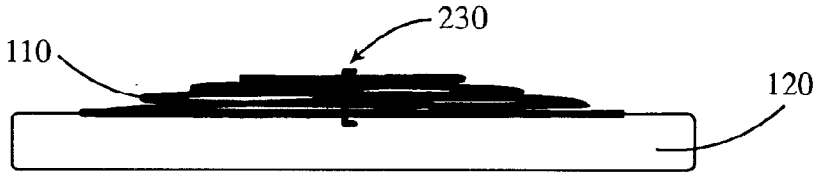
FIG. 2C show the front view of another embodiment of the flexible safety marker device of FIG. 1 in a reduced, compact position, implementing a holding means according to the present invention.
Figure 2D:
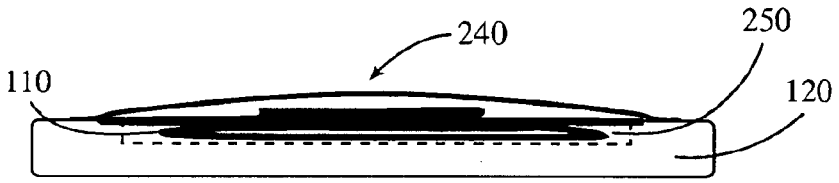
FIG. 2D show the front view of another embodiment of the flexible safety marker device of FIG. 1 in a reduced, compact position, implementing a holding means according to the present invention.

FIG. 1 shows an exemplary embodiment of a marker device 100 according to the present invention. Marker device 100 includes a base 120 with an opening 150 and a flexible means 110 in the form of a coil or spring. Opening 150 is preferably sufficiently large to allow stacking. The bottom end of the flexible means 110 is attached to the base 120 and preferably coils over and around the center of the base 120 in decreasing diameters without overlapping. In some embodiments, the bottom end of the flexible means 110, which is not limited to one complete loop and could have less or more, has a diameter that is sufficiently larger than the opening 150 to prevent the flexible means 110 from being pushed through the opening 150.

Base 120 provides the support of the marker-device 100 and keeps the marker device 100 on the ground or surface. Base 120 could take any shape and could be made out of any material as long as it provides the required support and stability of the marker device 100. Optionally, the base 120 may include additional support members 160 as shown in FIG. 1. Support members 160 may be made of the same or different material as the base 120 and may be made as a part of the base 120 during manufacturing or separately attached thereto during assembly.

The weights of the components of the marker device 100 should be distributed and allocated in a manner such that the marker device 100 has a very low center of gravity. More specifically, the weight of the base 120 should be significantly larger than the combined weight of all other components positioned on top thereof. Furthermore, the dimensions of the base 120 should be sufficiently large enough to support, in a stable fashion, the entire marker device 100 regardless of direct or indirect perturbations. The measurements of the base 120 could be, but is not limited to, about 14" in length by about 14" in width, which is the standard base size for conventional safety cones (e.g., 18" and 28" high cones) in the United States. The height of the base 120 could be about one inch, including the support members. The materials that could be used for the base include, for instance, but not limited to, rubber, recyclable rubber, soft/hard plastic, PVC, any type of wood including bamboo or wood compositions, metal, and the like.

The marker device 100 includes a flexible lightweight cover 140 that covers the flexible means 110. Preferably, cover 140 is made of a material that is breathable, flexible, durable, and highly visible. Cover 140 should offer little or minimal resistance to wind and the movement of the flexible means 110. That is, it should allow the wind (natural or traffic) to pass through and allow the marker device 100 to easily flex, bend, or fold.

Examples of suitable cover materials include, for instance, but not limited to, a mesh-type material, vinyl, canvas, polyester, and the like. Furthermore, the outside of the cover could include all kinds of shapes and/or reflective material in all or some portions thereof to enhance visibility. Preferred shapes and configurations (reflective collar(s), stripes, or other types of regulatory shapes or signs) comply to the recommendations made by the local, state, and/or federal traffic safety authority (e.g., the Federal Highway Administration of the U.S. Department of Transportation). In addition, cover 140 may include a highly reflective material imprinted, in all or some portions thereof, with common traffic control or warning signs.

Both the top and the bottom of the cover 140 could be attached to the flexible means 110. Alternatively, only the bottom of the cover 140 is attached to the base 120. The means for attaching the cover 140 includes, for instance, but not limited to, stitches, clamp(s), wire(s), ring(s), elastic band(s), adhesive, glue, Velcro, and so on. Alternatively, cover 140 could fit tightly over flexible means 110. In this case, it may not be necessary to use any attaching means to attach the cover 140 to the flexible means 110 or to the base 120.

Flexible means 110 as shown in FIG. 1 is a conical-shaped coil or spring. Flexible means 110 maintains an original upright position absent any perturbation. It deviates from the original position when an indirect (non-contact) or direct (contact) perturbation is present. When the perturbation disappears, the flexible means 110 promptly returns back to its original upright position. Examples of indirect (non-contact) perturbations include, for example, but not limiting to, perturbations caused by natural wind, traffic wind, ground-shaking caused by earthquakes or ground work, falling or being dropped on the ground, and so on. Examples of direct (contact) perturbations include, for example, but not limiting to, perturbations from vehicles hitting the marker device, vehicles running over or into the marker device, violence, etc.

Figure 6:
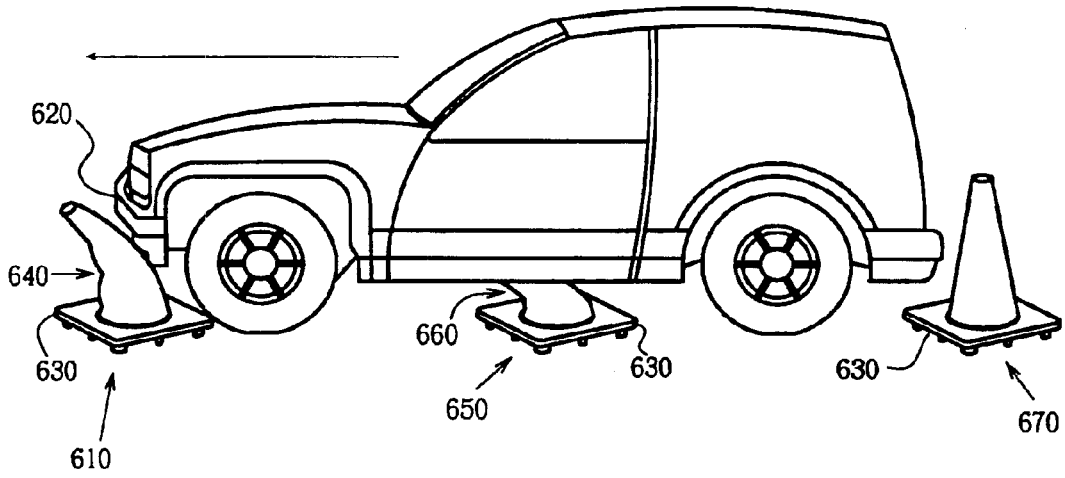
FIG. 6 illustrates the degree of flexibility of the flexible safety marker device of FIG. 1.

The applied (direct and/or indirect) perturbation force (F) applied at the flexible means for a period of time is characterized as an impulse. The mechanical definition of impulse is the action of a force during a very small time interval. To sustain direct and indirect perturbations without having the marker device permanently fallen over, the material properties of the flexible means require a fast impulse response to these direct and indirect perturbations; i.e., the flexible means needs to respond fast by flexing, bending and/or folding to any direction in response to the externally applied (indirect and/or direct) force, such as being run over by a vehicle as shown in FIG. 6. The direction and amount of deviation from its original position is directly related to the direction and amount of the perturbation force it sustains. Once the perturbation force is removed or disappears, flexible means restores from the deviated position back to its original position almost immediately.

FIG. 6 shows a situation where a car 600 runs into and over a flexible marker device according to the present invention. When car 600 hits marker device 610 with bumper 620, base 630 remains on the ground while the flexible means and cover thereof were bent as a result of the direct perturbation from the bumper 620, as indicated by 640. When marker device 650 is under the car 600, base 630 again remains on the ground while the flexible means and cover thereof were bent as a result of the direct perturbation from the car 600, as indicated by 660. The marker device 650 re-positions itself to the original upright position when the car 600 is no longer on top, as indicated by 670.

As the above example illustrates, the marker device according to the present invention is substantially flexible and resilient. It is, however, not a collapsible device by design. Collapsible devices, such as Kwok's mobile warning sign and Ho's telescopic roadblock discussed above, are particularly designed to have certain structurally weak points to allow collapsing, folding, compressing, or fail upon impact. U.S. Pat. No. 6,622,408, issued to Dicke, further illustrates this point. Dicke discloses a lightweight collapsible sign that is suspended from a support tub. The support tube is connected to a support base through a connecting member that includes a plurality of weakening members which cause the connecting member to fail upon impact.

Collapsible cones provide a more convenient alternative to carrying cumbersome rigid cones that would take up a large amount of space in a trunk or cargo area of a consumer vehicle. Certain collapsible devices, such as Dicke's lightweight collapsible sign, provide a safer alternative to stubborn rigid cones that may otherwise direct or indirectly cause damage and/or bodily injury upon impact. However, these alternatives only solve certain problems.

As discussed above, a major problem with the current safety cones is their rigid, unyielding nature and their tendency to fall over when confronted by an indirect or direct force, e.g., natural wind, passing traffic, or violence. Since a rigid cone is unable to self-right in response to indirect and/or direct perturbations, it becomes a dangerous object or obstacle. For example, after being run over or hit by a vehicle, a rigid cone could become a flying object dangerous to traffic and surrounding people.

On the other hand, collapsible cones are designed to be as flat as possible so that they take up less space to carry, transport, or store. Collapsible cones are structurally weaker and less resilient than the rigid cones. Furthermore, similar to rigid cones, collapsible cones cannot self-right. Thus, when confronted by an indirect or direct force such as passing traffic or violence, collapsible cones can be as dangerous as rigid cones.

Fallen, collapsed, broken, damaged or otherwise incapacitated safety cones and road sign devices, be they rigid or collapsible, impose a serious threat to the public safety. They can be found littered on highways, roads, and streets and remain a major safety concern for all involved, especially construction workers, utility service workers, police officers, motorists, and pedestrians.

The flexible marker device of the present invention, such as one shown in FIG. 1, is particularly designed with a reliable and safe self-righting mechanism to address this major safety issue without the common deficiencies exist in today's traffic safety cones and marker devices. The flexible marker device of the present invention has a substantially fast impulse response to indirect and direct perturbations, enabling the marker device to consistently maintaining an upright position despite of the perturbations.

In some applications, such as for individual use, it would be desirable to condense the new flexible marker device so that it is easier to carry, transport, display, and/or store. The marker device 100 could easily be reduced in size to a compact package and would therefore be a perfect candidate to be used as a personal safety cone in, e.g., a consumer vehicle. Reducing the marker device 100 could be as simple as pushing down the top 130 of the flexible means 110 toward the base 120. Once the marker device 100 is in a reduced size position, a holding/locking means is preferably utilized to keep the flexible means 100 in that reduced, compact position.

FIGS. 2A–2D show a variety of possible holding means, e.g., 210, 220, 230, and 240, that could be integrated or otherwise implemented with the marker device 100. Each holding means in FIGS. 2A–2D respectively keeps the flexible means 110 to the base 120 in a reduced and compact position. Such a holding means could be a hook, latch, strap, Velcro, pin, lock or any type of mechanism that serves as a holding/locking mechanism as they are known in the mechanical art.

For example, holding means 220 could be a hook mechanism that could connect the top of flexible means 110 to the base 120, e.g., the bottom or inside part of base 120. The base 120 could have a through hole opening 150 or a recessed area 250 to receive and store the flexible means 110, as indicated by dashed lines, respectively in FIGS. 2A and 2D. Holding means 230 is an example of a hook mechanism that could connect the topmost coil of flexible means 110 to the lowest coil thereof. Holding means 240 is an example of a strap that could be positioned over the top of the flexible means 110 and may be affixed to the base 120, e.g., by a lock, Velcro, knot, screw, and the like. Holding means 210 is exemplified below with reference to holding means 360 of FIG. 3 and holding means 460 of FIG. 4.

Figure 3:
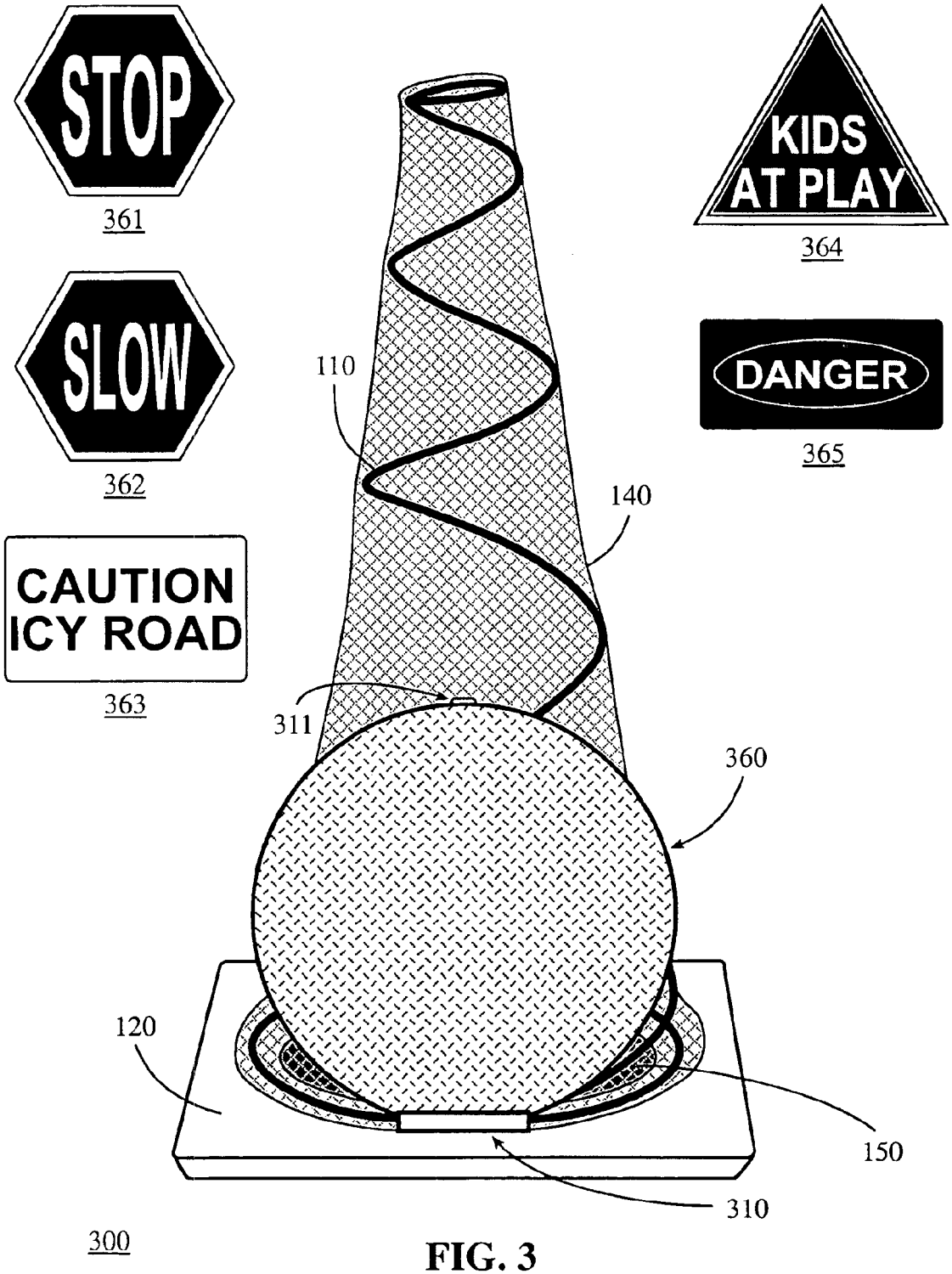
FIG. 3 is a three dimensional view of an embodiment of FIG. 2A.

FIG. 3 shows an integrated compact safety marker device 300 having a holding means 360 in the form of a cover or lid. Holding means 360 is pivotally mounted onto the base 120 at one end via a movable joint or hinge 310. Securing means 311 is attached to the holding means 360 at the opposite end thereof for securing the holding means 360 to the base 120 when the flexible means 110 is condensed to a compact size. In some embodiments, the securing means 311 is a lock, a hook, a switch, a strap, a Velcro, a latch, or a click-mechanism, etc.

Figure 5:
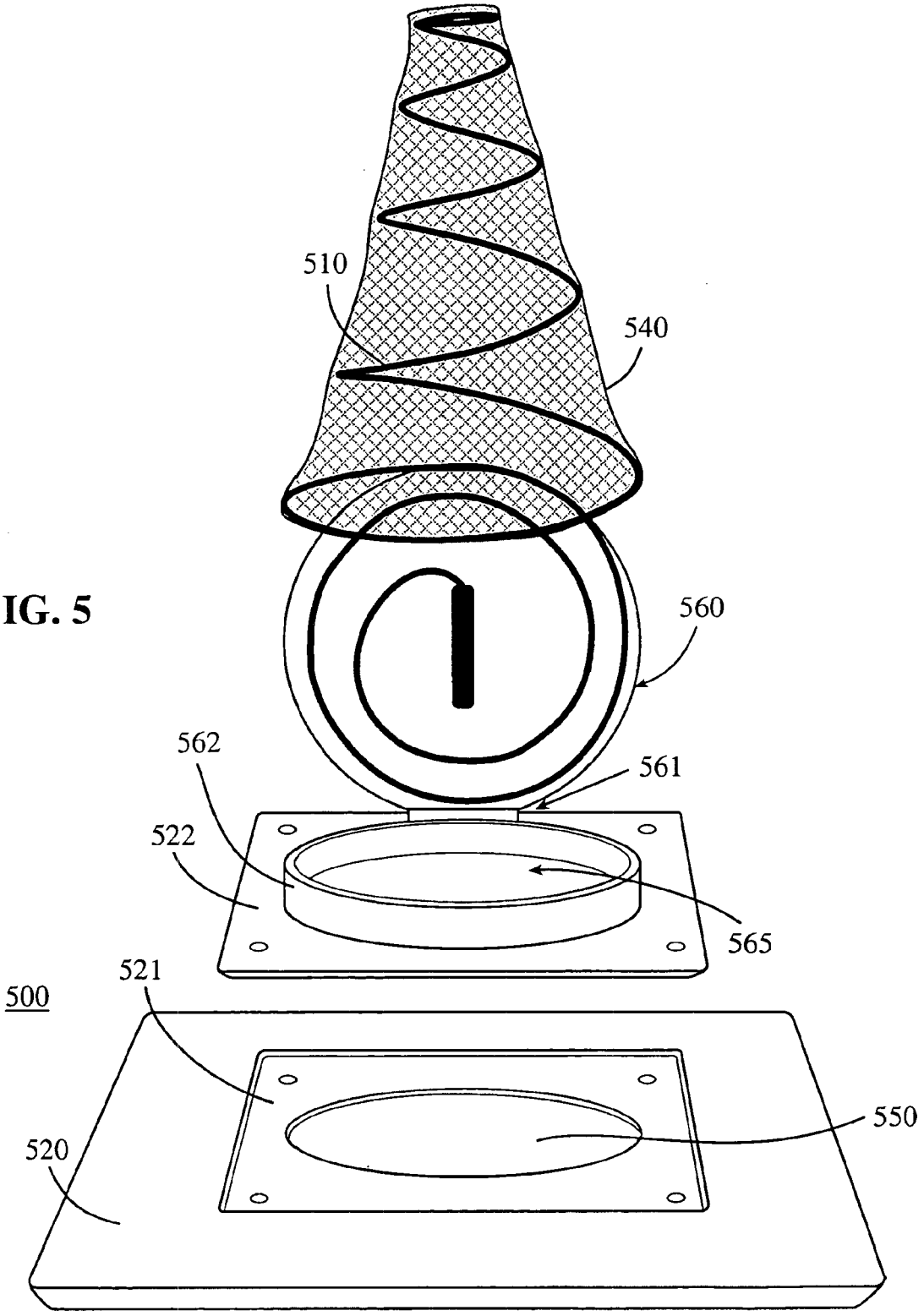
FIG. 5 is a three dimensional view of an embodiment of FIG. 3.

When the lid 360 is closed, the marker device 300 takes the form of a carry case or box. In embodiments where the opening 150 is a through hole, the bottom end of the flexible means 110 has an overall diameter that is sufficiently larger than the diameter of the opening 150, preventing the flexible means 110 from being pushed completely through the opening 150. In some embodiments, the base 120 may not have an opening. In these cases, the marker device may include an additional enclosure or housing member to receive and store the flexible means 110, e.g., an enclosure 565 defined by a wall 562 as shown in FIG. 5. Lid 360 could also include a groove or concave part (not shown) inside the lid 360 to guide the top of the flexible means 110 and to keep the flexible means 110 in place when closing the lid 360.

Preferably, the lid 360 is designed to additionally function as a sign. In some embodiments, the movable joint 310 has a spring, embedded inside or otherwise integrated therein, that causes the lid 360 to, upon the release of the securing means 311, travel about 45 degrees or more, from the closed position to an upright or display position.

As one skilled in the art will appreciate, the lid can be made of a variety of suitable lightweight but sturdy and durable materials, which could be the same or different from the material of the base, e.g., aluminum, stainless steel, plastic, etc. One skilled in the art will also appreciate that the outside surface of the lid 360 could be painted or otherwise imprinted with a variety of traffic and warning signs, such as signs 361, 362, 363, 364, and 365 shown in FIG. 3. Alternatively, the lid 360, as well as its corresponding enclosure/housing structure, if applicable, could take other shapes, sizes, and forms, e.g., octagon, square, rectangle, triangle, oval, etc. These lid signs can be designed with a variety of colors and/or reflective materials appropriate for their display functionality. Accordingly, the drawings shown and described herein are not to be construed as limiting the scope of the present invention.

Figure 4A:
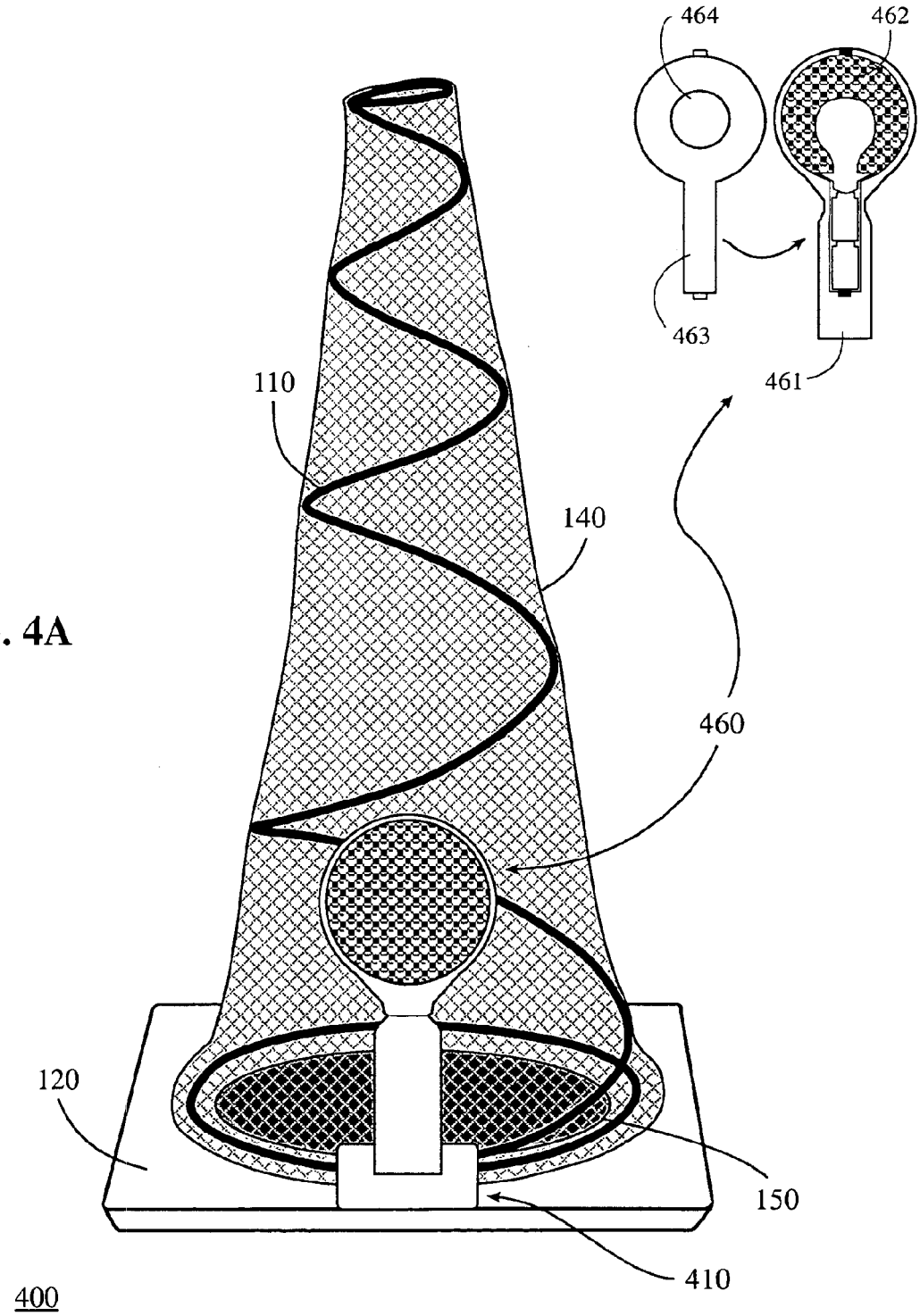
FIG. 4A is a three dimensional view of another embodiment of FIG. 2A.

FIG. 4A shows an integrated compact safety marker device 400 having a holding means 460 in the form of a light-emitting device. The light-emitting device 460 includes a housing 461, a front light cover 462, a back cover 463, a body member 464, a light bulb, and a power supply such as batteries for the light bulb.

Figure 4B:
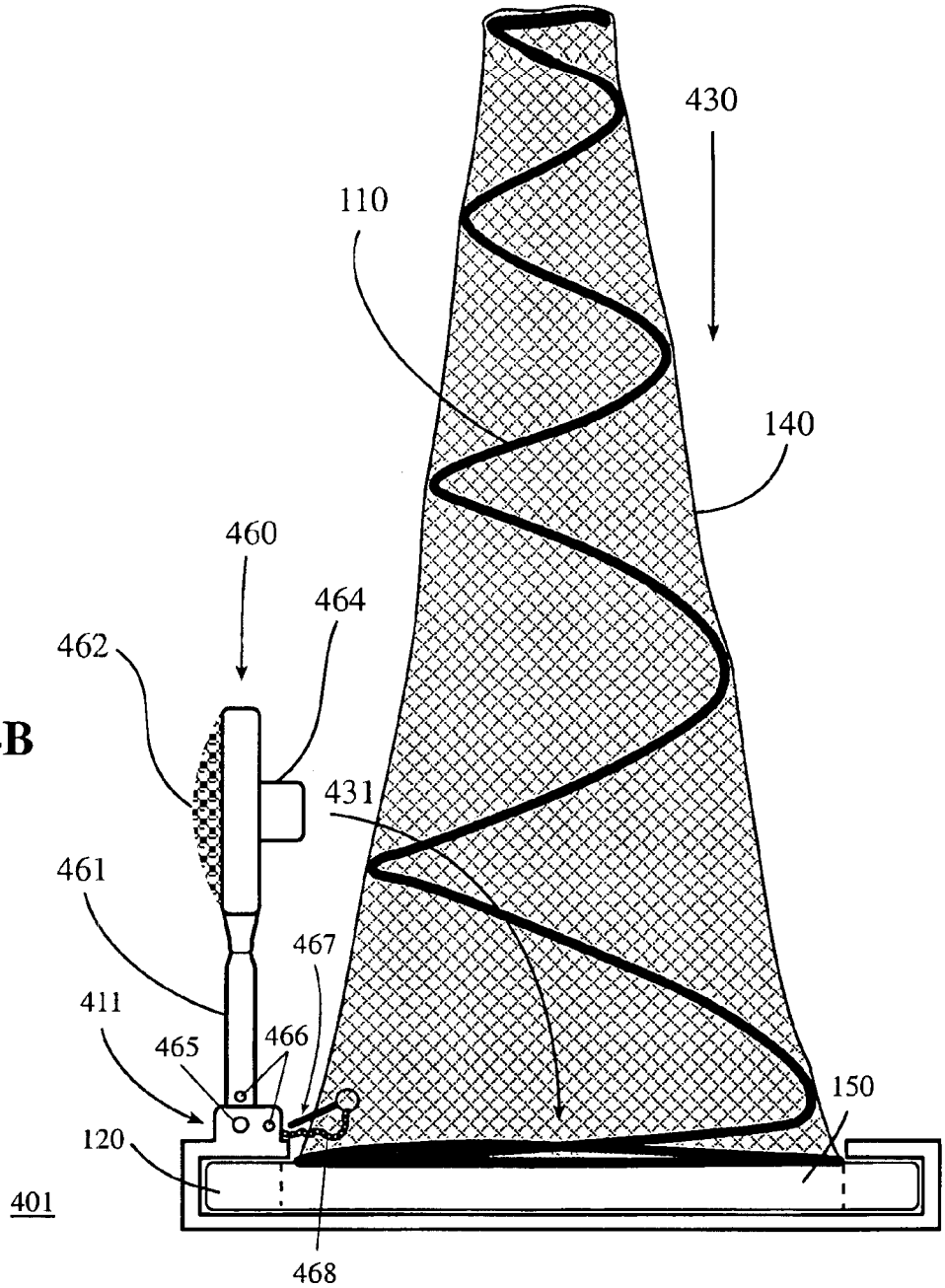
FIG. 4B is a side cross-sectional view of FIG. 4A in use.

The holding means/light-emitting device 460 is pivotally mounted to the base 120 via a movable joint 410. The movable joint 410 may include a hinge 465 and a locking pin hole 466, as shown in FIG. 4B. The holding means/light emitting device 460 has a corresponding locking pin hole 466 as shown in FIG. 4B. The marker device 400 may not or may have a securing means (not shown). Alternatively, the movable joint may be manufactured as a part of another structure, e.g., an enclosure 411 for the marker device 401 shown in FIG. 4B.

Figure 4C:
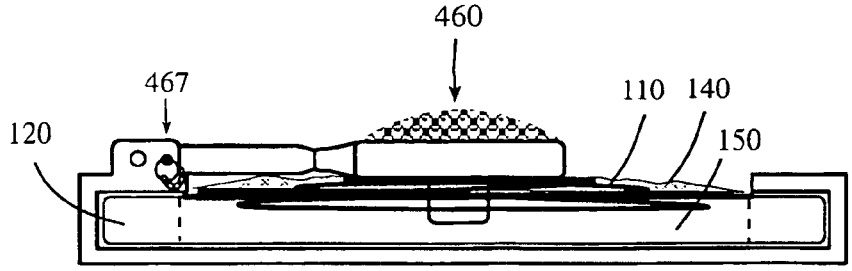
FIG. 4C is a side cross-sectional view of FIG. 4A in a reduced size position.

A locking pin 467 can be attached to the enclosure 411, the movable joint, or the base 120 via a link 468, which could be a chain or any suitable connecting means. After the flexible means 110 is compressed or pushed downward as indicated by arrow 430, the holding means/light-emitting device 460 is turned (flipped) in a direction indicated by arrow 431 to a holding/locking position where the two locking pin holes 466 are aligned. The locking pin 467 is then conveniently inserted into the two aligned holes 466 as shown in FIG. 4C.

Preferably, the movable joint has a spring embedded or otherwise integrated therein that would, upon the release of the locking pin 467, cause the light-emitting device 460 to travel about 45 degrees or more from the holding/locking position to an upright or display position.

The light-emitting device 460 may be configured to turn on automatically when the locking pin 467 is released. Alternatively, the light-emitting device 460 may include a switch, allowing a user to manually turn it on and off. It is anticipated that, as the technology advances, it is possible to integrate a sensor and/or an alarm in the marker device, e.g., the base, the holding means, the enclosure, etc. The alarm would sound when the sensor senses that an object such as a child or a vehicle has come within a predetermined parameter of the marker device. This could be very useful when the visibility is low and/or when the pedestrian is unable to see or understand the marker device.

Once in the locking position, the body member 464 of the light-emitting device 460 functions to prevent the flexible means 110 from moving. The body member 464 can be hollow or solid. It is a part of and extends from the outside of the back cover 463. The body member 464, whose shape is not limited to cylindrical, is slightly smaller than the topmost loop of the flexible means 110. As such, when in the holding/locking position, the holding means/light-emitting device 460 holds down and locks the flexible means 110 via the locking pin 467 while the body member 464 extends and fits inside the loops of the flexible means 110 to prevent them from moving.

Figure 4D:
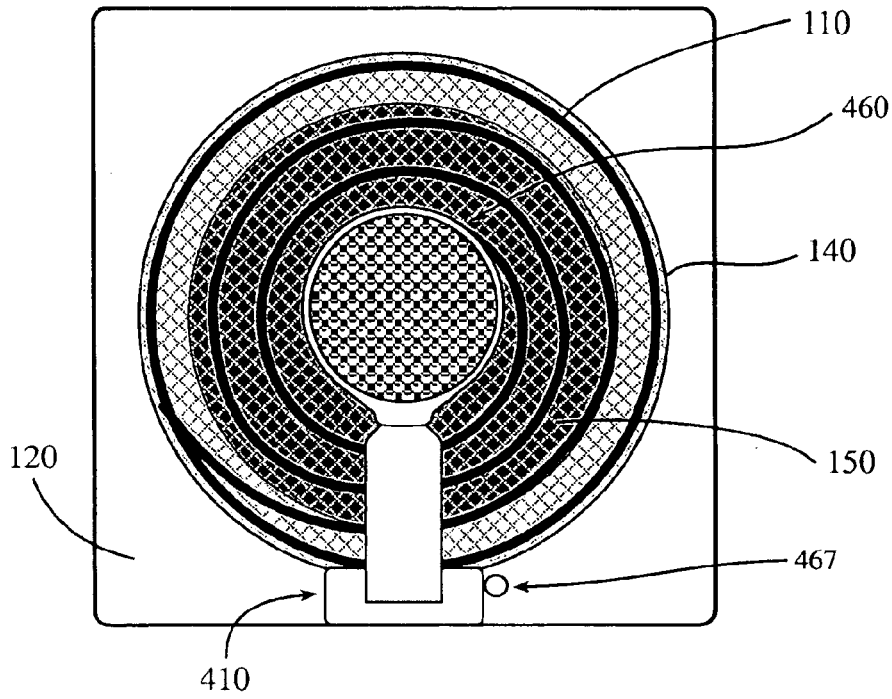
FIG. 4D is a top view of FIG. 4C with a locking pin.

FIG. 4D shows a top view of the marker device 400 in a compact position with the locking pin 467 inserted. For the sake of clarity, the cover 140 is shown without folds. However, as one skilled in the art will understand, along with the flexible means 110, the cover 140 would also be in a compressed or condensed form in such a reduced, compact position. The number of loops of the flexible means 110 could also vary, e.g., 2–10, and therefore is not limited to what is shown.

Figure 4E:
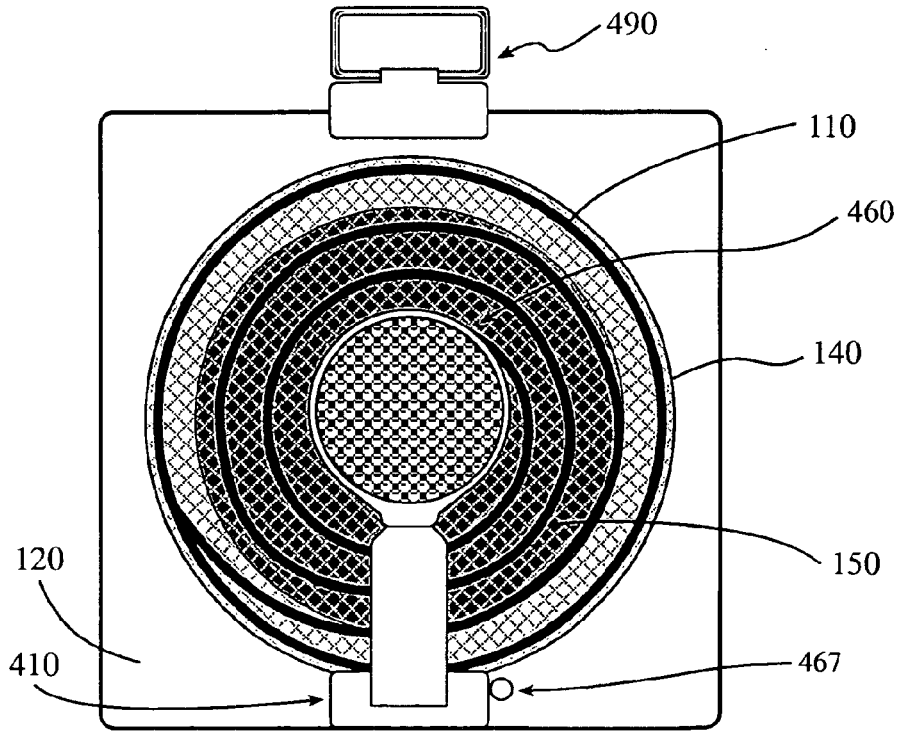
FIG. 4E is a top view of FIG. 4C with a locking pin and a handle.

In some embodiments, the flexible safety marker device is integrated with a handle, making it even easier to carry, store, or display the device. FIG. 4E shows a handle 490 mounted on the opposite end of the movable joint 410. However, one skilled in the art will appreciate that the handle 490 can be positioned in any suitable place and can be mounted on, integrated into, or made part of the base 120, the enclosure 411, the movable joint 410, or the holding means 460. Again, the drawings shown and described herein are not to be construed as limiting the scope of the present invention. For example, the light-emitting device may be configured or otherwise designed in various shapes, colors, sizes, and forms, and made of a variety of materials. The light-emitting device could also be designed and configured as a sign with appropriate colors, shapes, reflective materials, sizes, and forms.

FIG. 5 shows yet another embodiment of an integrated compact safety marker device 500. When condensed, the marker device 500 takes the form of a carry case or box. The marker device 500 is similar to the marker device 300 shown in FIG. 3. However, in this embodiment, the flexible means 510 is securely and permanently attached, for example, welded, to the lid 560. Cover 540 tightly fits over the flexible means 510 without attaching means. Alternatively, cover 540 is affixed to the flexible means 510 via suitable attaching means such as adhesive, wires, strings, elastic bands, etc., as discussed above.

The marker device 500 can be reduced to a compact size in a manner similar to the marker device 300 shown in FIG. 3 except that the flexible means 510 and the cover 540 are received and held inside the enclosure 565 defined by the wall 562 and the lid 560. The lid 560 is attached to the enclosure 565 via a movable joint 561. The movable joint 561 is similar to the movable joints 310 of FIG. 3 and the movable joints 410 of FIG. 4A. The lid 560 can have a groove or concave part (not shown) on the inside surface to fit over the enclosure 565.

In some embodiments, base 522 does not have an opening, which typically is useful for staking cones. In some embodiments, the enclosure 565 is open at the bottom. Alternatively, the marker device 500 may be secured, e.g., via four screws, to a foundation 520 having a recessed area 521. The foundation 520 adds weights to the marker device 500, further strengthening and enhancing its stability. The recessed area 521 is in a shape and dimension that would accommodate the shape and dimension of the base 522. The recessed area 521 may have an opening or recessed area 550 that would accommodate the shape defined by the wall 562.

Base 522 could have a body member (not shown) similar to the body member 464 in the center of the enclosure 565 to keep the flexible means 510 in place when the lid 560 is closed. The lid 560 could have a securing means (not shown) similar to the securing means 311 shown in FIG. 3 or a locking pin (not shown) similar to the locking pin 467 shown in FIG. 4E.

Similar to the lid 360 of FIG. 3, the lid 560 could be used as a display means to place signs or logos on its outside surface. For instance, the lid could include a logo (e.g., of a company logo or an event logo), a warning sign, a traffic signal/sign, and the like.

Once the safety cone is reduced/condensed and held/locked in a compact position, it could be included, stored, or transported in a variety of housing means such as an emergency kit. The emergency kit could store additional safety or emergency equipment such as, but not limited to, a flash light, one or more hand tools, a vest, one or more flares, and the like. Emergency kit could be organized in compartments of the housing, which could be a case. The case may have a handle, a shoulder strap or straps to carry the case on a person's shoulder or back.

Although the present invention and its advantages have been described in detail, it should be understood that the present invention is not limited to or defined by what is shown or discussed herein. The drawings, description and discussion herein show examples of the invention and provide examples of using the invention. One skilled in the art will realize that implementations of the present invention could be made without departing from the principles, spirit or legal scope of the present invention. Accordingly, the scope of the present invention should be determined by the following claims and their legal equivalents.

What is claimed is:

1. A safety marker device, comprising:

(a) a base having a circular opening;

(b) a flexible means coiling over said base in decreasing diameters around the center of the opening; wherein the largest of said diameters is sufficiently larger than the diameter of the circular opening; and wherein said flexible means having a degree of flexibility enabling a fast impulse response to direct and indirect perturbations; wherein said flexible means maintains in an original position in absence of said indirect and direct perturbations and flexes from said original position to a bent position in presence of any of said indirect and direct perturbations, wherein said bent position is characterized by having part of said flexible means bent up to a substantially horizontal position with respect to said base, and (c) a cover covering said flexible means; wherein said safety marker device has a substantially low center of gravity and is capable of self-righting substantially immediately after being run over by a vehicle or dropped on the ground;

wherein the improvement comprises:

(d) a holding means attached to said base for holding down said flexible means to said base in a reduced, compact position; wherein said holding means is selected from the group consisting of a cover, a lid, a light-emitting device, a sign, a mirror, a box, a case, a hook, a latch, a strap, Velcro, a pin, a lock, and combination thereof.

2. The improvement of claim 1, wherein said holding means is integrated to said base.

3. The improvement of claim 1, wherein said holding means is attached to said base via a movable joint.

4. The improvement of claim 3, wherein said movable joint is a hinge.

5. The improvement of claim 3, further comprises a locking mechanism, wherein said movable joint has a spring mechanism that causes said holding means to self-erect upon release of said locking mechanism.

6. The improvement of claim 1, wherein said lid is characterized as having a circular, triangle, square, rectangular, oval, square, or irregular shape.

7. The improvement of claim 1, further comprises a securing means attached to said lid for securing said lid to said base.

8. The improvement of claim 7, wherein said securing means is a latch, a lock, or a pin.

9. The improvement of claim 8, wherein said lid is characterized as a self-erecting sign.

10. The improvement of claim 8, wherein said self-erecting sign is attached to said base via a movable joint, wherein said movable joint comprises a spring mechanism that causes said lid to travel more than 45 degrees to an upright or display position upon release of said securing means.

11. The improvement of claim 1, wherein said light-emitting device is attached to said base via a movable joint, said light-emitting device comprising a light source, a housing in which said light source resides, and a power supply for powering said light source.

12. The improvement of claim 1, wherein said light emitting device further comprises a body member perturbing from one side of said housing, wherein said body member has a cross-sectional size that is slightly smaller than the smallest of said diameters of said flexible means such that, when in said reduced, compact position, said body member prevents said flexible means from moving.

13. The improvement of claim 12, wherein said body member is hollow or solid and wherein said body member is characterized as a cylinder or a stick.

14. The improvement of claim 12, further comprising a locking pin connected to said base for locking said light emitting device in said reduced, compact position.

15. The improvement of claim 1, further comprising a handle integrated or attached to said base.

* * * * *